US010059565B2

(12) United States Patent
Alasentie et al.

(10) Patent No.: US 10,059,565 B2
(45) Date of Patent: Aug. 28, 2018

(54) REDUCING ELONGATION OF ROPING OR BELTING OF AN ELEVATOR BY PRETENSIONING THE ROPING OR BELTING OF THE ELEVATOR

(71) Applicants: Pentti Alasentie, Espoo (FI); Esko Aulanko, Kerava (FI); Matti Räsänen, Hyvinkaa (FI)

(72) Inventors: Pentti Alasentie, Espoo (FI); Esko Aulanko, Kerava (FI); Matti Räsänen, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/711,459

(22) Filed: May 13, 2015

(65) Prior Publication Data

US 2015/0284215 A1 Oct. 8, 2015

Related U.S. Application Data

(63) Continuation of application No. PCT/FI2013/051069, filed on Nov. 12, 2013.

(30) Foreign Application Priority Data

Nov. 16, 2012 (FI) ..... 20126205

(51) Int. Cl.
*B66B 5/12* (2006.01)
*B66B 11/00* (2006.01)

(52) U.S. Cl.
CPC ..... *B66B 5/12* (2013.01); *B66B 11/009* (2013.01)

(58) Field of Classification Search
None
See application file for complete search history.

(56) References Cited

U.S. PATENT DOCUMENTS 1,566,385 A * 12/1925 Dunn ..... B66B 1/3469 187/254
1,901,635 A 3/1933 Dunlop
2,270,441 A 1/1942 Hymans
(Continued)

FOREIGN PATENT DOCUMENTS

DE 1289969 B 2/1969
DE 1295150 B 5/1969
(Continued)

OTHER PUBLICATIONS

International Search Report PCT/ISA/210 for International Application No. PCT/FI2013/051069 dated Mar. 20, 2014.
(Continued)

*Primary Examiner* — Michael A Riegelman
(74) *Attorney, Agent, or Firm* — Harness, Dickey & Pierce, P.L.C.

(57) ABSTRACT

Example embodiments relate to an elevator. The elevator may include a car of the elevator and a counterweight that are to be moved reciprocally, at least one roping or belting traveling via a top pulley assembly for connecting the car of the elevator and the counterweight to each other via the top pulley assembly, and at least one roping or belting traveling via a bottom pulley assembly for connecting the car of the elevator and the counterweight to each other via the top pulley assembly.

13 Claims, 2 Drawing Sheets

(56) References Cited

U.S. PATENT DOCUMENTS

| | | | | |
|---|---|---|---|---|
| 3,174,585 | A | 3/1965 | Tofanelli | |
| 4,108,280 | A * | 8/1978 | Eastcott | B66B 11/0484 187/256 |
| 5,788,018 | A | 8/1998 | Mendelsohn et al. | |
| 6,193,017 | B1 * | 2/2001 | Koster | B66B 7/10 187/256 |
| 6,364,063 | B1 * | 4/2002 | Aulanko | B66B 11/008 187/251 |
| 6,425,463 | B1 * | 7/2002 | Broyan | B66B 7/062 187/254 |
| 6,508,051 | B1 | 1/2003 | De Angelis | |
| 6,860,367 | B1 * | 3/2005 | Ericson | B66B 11/008 187/251 |
| 6,868,661 | B2 | 3/2005 | Aulanko et al. | |
| 6,966,408 | B2 * | 11/2005 | Sweet | B66B 11/009 187/254 |
| 7,712,584 | B2 * | 5/2010 | Aulanko | B66B 11/08 187/254 |
| 8,100,796 | B2 | 1/2012 | O'Donnell | |
| 2002/0092285 | A1 | 7/2002 | Aulanko et al. | |
| 2006/0137896 | A1 | 6/2006 | O'Donnell | |
| 2008/0223665 | A1 | 9/2008 | O'Donnell | |
| 2009/0120733 | A1 * | 5/2009 | Mustalahti | B66B 7/10 187/404 |
| 2011/0094831 | A1 | 4/2011 | Jezek | |
| 2015/0197410 | A1 * | 7/2015 | Aulanko | B66B 1/40 187/264 |
| 2015/0210507 | A1 * | 7/2015 | Rasanen | B66B 7/10 187/265 |

FOREIGN PATENT DOCUMENTS

| | | | | |
|---|---|---|---|---|
| GB | 2250012 | A * | 5/1992 | B66D 5/08 |
| WO | WO-9829327 | A1 | 7/1998 | |
| WO | WO-2004029343 | A1 | 4/2004 | |
| WO | WO-2008112537 | A2 | 9/2008 | |
| WO | WO-2014/068183 | A1 | 5/2014 | |

OTHER PUBLICATIONS

Written Opinion of the International Searching Authority PCT/ISA/237 for International Application No. PCT/FI2013/051069 dated Mar. 20, 2014.

Finnish Search Report for FI20126205 dated Sep. 6, 2013.

Supplementary European Search Report dated Jun. 1, 2016 in corresponding European Application No. 13856024.8.

* cited by examiner

REDUCING ELONGATION OF ROPING OR BELTING OF AN ELEVATOR BY PRETENSIONING THE ROPING OR BELTING OF THE ELEVATOR

This application is a continuation of PCT International Application No. PCT/FI2013/051069 which has an International filing date of Nov. 12, 2013, and which claims priority to Finnish patent application number 20126205 filed Nov. 16, 2012, the entire contents of both of which are incorporated herein by reference.

FIELD OF THE INVENTION

Example embodiments relate to the field of elevator technology, and more particularly, to the implementation of ropings or beltings to be used in elevators.

BACKGROUND

The car of an elevator is usually suspended by means of roping or belting e.g. on a counterweight via a pulley assembly fixed to the roof of the elevator. Elongation of the roping or belting in a loading situation of the car of the elevator depends in this case on how far the car of the elevator is from the suspension pulley assembly. Elongation of the roping or belting in a loading situation is generally at its greatest when the distance of the car of the elevator from the suspension pulley assembly is at its greatest.

In practice this is because when the car of the elevator is at one of the lowermost floors of the building in which it is located—such as e.g. when the car of the elevator is at the basement floor, from which most of the passengers or load of the elevator come into the car—the elongation of the roping or belting is at its greatest in a loading situation.

It is not uncommon for elevator passengers to experience the elongation of the roping or belting in a loading situation as unpleasant, because in fact the car of the elevator displaces downwards from below the feet as the load of the car increases, whereas the expectation of a passenger would be for the car of the elevator to remain in its position.

Elastic elongation of the roping or the belting affects the sill height of an elevator car at a floor level. The ideal is that there is no sill between the floor level and the floor of the elevator car, and it is to be hoped that such a sill is not disturbing. When the elevator car is loaded, the roping tries to elongate and the floor of the elevator car sinks downwards, in which case a tripping hazard or other impediment can occur, e.g. the transfer of a wheelchair or a child's pushchair into the elevator car or out of the elevator car can become more difficult. The elongation differences of the roping caused by the loading at any given time of the elevator car might affect the accuracy of a run to a floor. Conventionally, the elevator car of a modern elevator is kept accurately at the level with the accurate leveling function of the moving machine. In this case, however, the brakes of the elevator must be kept open.

SUMMARY

Example embodiments reduce elongation of the roping or belting in a loading situation of the car of an elevator.

Example embodiments relate to an elevator. The elevator may include:

a) a car of the elevator and a counterweight that are to be moved reciprocally;

b) at least one roping or belting traveling via a top pulley assembly for connecting the car of the elevator and the counterweight to each other via the top pulley assembly; and c) at least one roping or belting traveling via a bottom pulley assembly for connecting the car of the elevator and the counterweight to each other via the bottom pulley assembly.

In a further example embodiment, in the elevator, at least one roping or belting traveling via the bottom pulley assembly is pretensioned or can be pretensioned.

Pretensioning to a certain minimum tension can be performed in advance and/or it can be performed from time to time, possibly even for each load separately. Pretensioning from time to time, i.e. occurring in operating situations of the elevator, is preferably performed e.g. by pulling the end of the roping or belting traveling via the bottom pulley assembly with a suitable pulling device, e.g. with a spring. The desired pretensioning can be locked to act on the loading during the next run of the elevator. Preferably the roping or belting traveling via the bottom pulley assembly is pretensioned by acting on the section between the elevator car and the bottom pulley assembly, particularly in those cases where the bottom pulley assembly is prevented from rotating.

Generally, the dynamics of the car of the elevator and of the counterweight can be modeled with a relatively simple mechanical spring model. When the car of the elevator, the car being loaded or to be loaded, acts as the mass, the roping or belting can be modeled as a type of spring.

Therefore, the elongation of the roping or belting in response to an increase (cf spring constant) in the load of the car of the elevator decreases when the car of the elevator and the counterweight are connected to each other not only via the top pulley assembly but also via the bottom pulley assembly using roping or belting for the connecting and when the connecting is implemented in such a way that at least one roping or belting traveling via the bottom pulley assembly is pretensioned.

As a result, it is possible to use in elevators ropes or belts of a high strength class at least in respect of one roping or belting at least as some of the ropes or belts. Ropes or belts of a high strength class are in principle too ductile for them to be used in elevators. They are, however, lighter because a rope or belt bearing a corresponding load is thinner and thus they offer an opportunity to make the motor needed for moving the car of the elevator smaller and in addition to this, or alternatively, to save energy when the mass to be moved is smaller.

Since the top pulley assembly, the bottom pulley assembly, or both, can both be braked with at least one brake, the braking force can be exerted on just the top pulley assembly, on just the bottom pulley assembly or on both. In this way it is possible to influence wear of the brakes and roping. Since both the top pulley assembly and the bottom pulley assembly can be braked, the braking force can be improved, which enables an increase in braking power or alternatively the braking power needed can be realized with lighter brake components.

When the elevator comprises tensioning means for tensioning the roping or belting, the precision needed in installing an elevator can be decreased and the servicing need reduced. According to a preferred embodiment the tensioning means are configured, or can be configured, to tension the roping or the belting traveling via the bottom pulley assembly. The tensioning means most preferably comprise a lock and a spring. The tensioning means preferably also comprise a tensioning limiter, which prevents and/or even discharges the pretensioning if the pretensioning is growing or grows to be too great.

An improvement for reducing elongation of the roping or belting of an elevator in a loading situation of the car of the elevator emerges when some elevator according to the invention is used in such a way that at least one roping or belting traveling via the bottom pulley assembly is pretensioned, in which case owing to the pretensioning at least one roping or belting traveling via the top pulley assembly and at least one roping or belting traveling via the bottom pulley assembly interact in such a way that the elasticity of the connected roping or belting to be formed in this way decreases compared to the situation before pre tensioning.

Example embodiments relate to use of pretensioning for bracing the roping or belting of an elevator. Preferably, the pretensioning force of the pretensioning is the magnitude of the weight of the nominal load permitted for the elevator car. The pretensioning force can also be other than this and it can be selected to be suitable according to the typical use or momentary use of the elevator. In the example embodiments hereinafter some suitable methods for pretensioning are described.

Example embodiments relate to elevators in which the contact between the roping or belting of the pulley belonging to the bottom pulley assembly pulling the elevator or belonging to the top pulley assembly pulling the elevator is gripping, e.g. owing to a high friction coefficient or owing to toothing of the belts of the belting.

In a further example embodiment, the pretensioning is changed in the stressed part of the roping traveling via the bottom pulley.

When using pretensioning for improving the bracing of the roping in a loading situation, it is advantageous to prevent during loading of the elevator car the rotation of the top pulley assembly or bottom pulley assembly, or both, of the roping to be braced. A good way to prevent rotation is to prevent the rotation of one or more pulleys, which belong(s) to the top pulley assembly or bottom pulley assembly, by the aid of a brake device acting on the pulley in question.

Example embodiments relate to elevators with machine above and to elevators with machine below.

BRIEF DESCRIPTION OF THE DRAWINGS

In the following the invention will be presented in more detail by the aid of some embodiments described by FIGS. 1 and 2.

The same reference numbers refer to the same parts in both FIGS.

DETAILED DESCRIPTION OF EXAMPLE EMBODIMENTS

Figure 1:
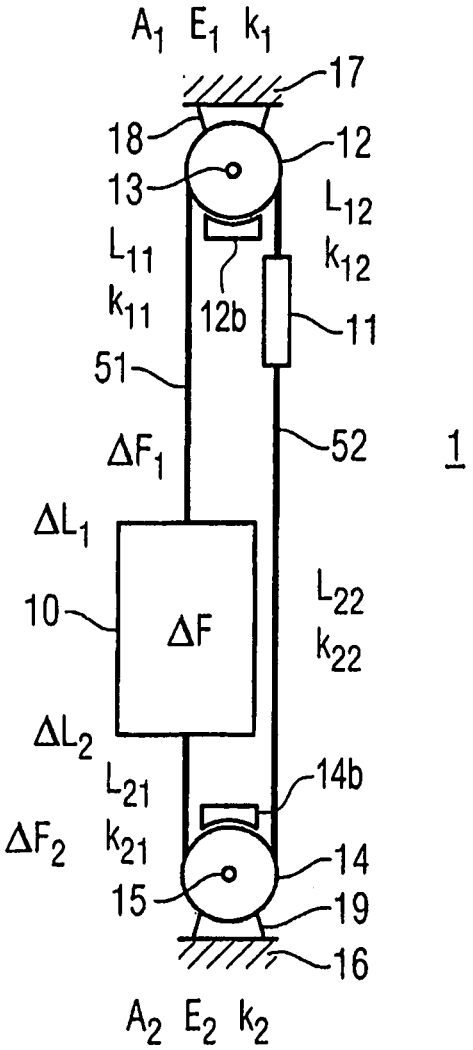
FIG. 1 illustrates a schematic view of the car of an elevator and a counterweight, which are connected to each other by the aid of ropings traveling via both a top pulley assembly and a bottom pulley assembly.

The displacement during loading of the car 10 of the elevator 1 according to FIG. 1 can be reduced, or the displacement can be minimized or even totally eliminated, by pretensioning the displacement ropes 51, 52 of the supporter force.

In a conventional elevator, the elasticity of the displacement ropes causes a displacement of the car during loading. The supporter is the rope between the car and the machine. The displacement is at its maximum when the car is at the bottommost level. In a conventional elevator, the supporters between the machine and the traction sheave participate in supporting the load coming into the car.

In the elevator 1, the car 10 and the counterweight 11 are connected in such a way that the displacement rope 51 passes around a pulley assembly (pulley 12 and shafting 13) that is rigidly fixed in the top end of the elevator hoistway and the displacement rope 52 passes around a pulley assembly (pulley 14 and shafting 15) that is rigidly fixed in the bottom end of the elevator hoistway in such a way that the length of the "supporter loop" thus produced remains constant and pretensioning is performed on this loop. The displacement during loading of the car 10 essentially decreases because the displacement ropes 51, 52, i.e. the whole loop, support the car 10.

One of the two pulleys 12, 14 is the traction sheave of the machine of the elevator 1. During the loading the brake of the machine prevents rotation of the traction sheave 12, 14 (the brake acts at the point of the supporter 18, 19 on the side of the traction sheave). The elevator 1 can also comprise a second brake, which prevents the rotation of the second pulley 12, 14 and the movement of the supporters (the brake acts at the point of the supporter 18, 19 of the pulley on the opposite side to the traction sheave).

The system thus produced is significantly stiffer than a conventional elevator system. The amount of leveling starts of the electric drive of the drive machinery of the elevator 1 can be essentially reduced and comfort in the car 10 improved when the movement of the car 10, particularly on the bottommost floor (which is in most cases the main floor) can be reduced to somewhere around one one-hundredth of what is conventional.

In high-rise buildings the lateral swinging of the displacement ropes caused by swaying of the building is a problem. When the displacement ropes 51, 52 are pretensioned between two rigidly fixed pulleys 12, 14, the amplitude during lateral swinging of the displacement ropes 51, 52 is smaller than in a conventional solution, in which the pulley 14 of the bottom end of the hoistway is able to move in the vertical direction.

In a conventional solution the own mass of the displacement ropes cannot be reduced by using displacement ropes of a high strength class, because the flexing of the displacement ropes would become too great. In the elevator 1 according to the invention the use of displacement ropes of a high strength class as the displacement ropes 51, 52 is possible owing to the increased load-bearing cross-section.

There follows an example calculation for an elevator 1 comprising steel ropes as the displacement ropes 51, 52:

According to our model, the bulk factor of the cable is 0.622 and the cable weighs 1.2 kg/m.

According to our model, the elongation $\Delta L_i$ of each displacement rope 51, 52 is proportional to the change $\Delta F_i$ in the force acting at any given time on the displacement rope 51, 52 in question:

$$\Delta L_i = k_i \Delta L_i \tag{1.1}$$

On the other hand, the change in the force is exerted on both ropes:

$$\Delta F_1 + \Delta F_2 = \Delta F \tag{1.2}$$

The change $\Delta L_i$ in the length of each displacement rope 51, 52 is equal $$\Delta L_1 == \Delta L_2 \quad (1.3).$$

According to its definition, for the spring constant:

$$k_i = \frac{A_i E_i}{L_i}. \quad (1.4)$$

On the basis of equations (1.4), (1.1) and (1.3), we can write:

$$\frac{\Delta F_1}{k_1} = \frac{\Delta F_2}{k_2} = \frac{\Delta F - \Delta F_1}{k_2}. \quad (1.5)$$

From this we can solve $\Delta F_1$:

$$\Delta F_1 = \frac{k_1}{k_1 + k_2} \Delta F. \quad (1.6)$$

On the basis of equation (1.1) we can write:

$$\Delta L_1 = \frac{\Delta F_1}{k_1} \quad (1.7)$$

in which $k_1$, and $k_2$ can be determined separately for each of the cases we want.

The general parameters of our model can be seen in Table 1:

TABLE 1

| general parameters | | | | | |
|---|---|---|---|---|---|
| Pretensioning force → nominal load | 0.00 | 0.25 | 0.50 | 0.75 | 1.00 |
| Load of car (%) | 100 | 100 | 100 | 100 | 100 |
| Load (kg) | 1800 | 1800 | 1800 | 1800 | 1800 |
| Distance (m) | 240 | 240 | 240 | 240 | 240 |
| Nominal load (kg) | 1800 | 1800 | 1800 | 1800 | 1800 |
| Car + displacement ropes | 3450 | 3450 | 3450 | 3450 | 3450 |
| Average brake force (min.) | 149832 | 149832 | 149832 | 149832 | 149832 |
| E1 (N/mm$^2$) | 75000 | 75000 | 75000 | 75000 | 75000 |
| E2 (N/mm$^2$) | 75000 | 75000 | 75000 | 75000 | 75000 |
| A1 tot. (mm$^2$) | 841 | 841 | 841 | 841 | 841 |
| A2 tot. (mm$^2$) | 803 | 803 | 803 | 803 | 803 |
| k11 (N/m) | 259585 | 344695 | 512839 | 1001257 | 21026394 |
| k21 (N/m) | 21026394 | 1001257 | 512839 | 344695 | 259585 |
| k21 (N/m) | 20072195 | 955819 | 489566 | 329052 | 247805 |
| k21 (N/m) | 247805 | 329052 | 489566 | 955819 | 20072195 |
| k1a (N/m) | 256419 | 256419 | 256419 | 256419 | 256419 |
| k2a (N/m) | 244783 | 244783 | 244783 | 244783 | 244783 |

Case 1: The top pulley 12 is braked and the bottom pulley 14 is free to rotate.

$$k_1 = k_{11} = \frac{A_1 E_1}{L_{11}}$$

$$k_{12} = \frac{A_1 E_1}{L_{12}}$$

$$k_{2a} = \frac{A_2 E_2}{L_{12} + L_{22}}$$

-continued $$k_2 = \frac{k_{12} k_{2a}}{k_{12} + k_{2a}}$$

The data for Case 1 are in Table 2.

We observe that if the traction sheave 12 in the top end or the traction sheave 14 in the bottom end must be braked, the corresponding displacement in the top end or in the bottom end is 35.2 mm, i.e. approx. one-half compared to the conventional elevator system presented below.

TABLE 2

| Pretensioning force → nominal load | 0.00 | 0.25 | 0.50 | 0.75 | 1.00 |
|---|---|---|---|---|---|
| k1 (N/m) | 259585 | 344695 | 512839 | 1001257 | 21026394 |
| k2 (N/m) | 241966 | 196696 | 165695 | 143136 | 125983 |
| dF1 (kg) | 932 | 1146 | 1360 | 1575 | 1789 |
| dF2 (kg) | 868 | 654 | 440 | 225 | 11 |
| dL car (mm) | 35.2 | 32.6 | 26.0 | 15.4 | 0.8 |
| 75 kg → dL car (mm) | 1.5 | 1.4 | 1.1 | 0.6 | 0.0 |

Case 2: the bottom pulley 14 is braked and the top pulley 12 is free to rotate:

$$k_1 = \frac{k_{1a} k_{22}}{k_{1a} + k_{22}}$$

$$k_{1a} = \frac{A_1 E_1}{L_{11} + L_{12}}$$

$$k_{22} = \frac{A_2 E_2}{L_{22}}$$

$$k_2 = k_{21} = \frac{A_2 E_2}{L_{21}}$$

The data for Case 2 are in Table 3.

TABLE 3

| Pretensioning force → nominal load | 0.00 | 0.25 | 0.50 | 0.75 | 1.00 |
|---|---|---|---|---|---|
| k1 (N/m) | 126019 | 144115 | 168280 | 202180 | 253185 |
| k2 (N/m) | 20072195 | 955819 | 489566 | 329052 | 247805 |
| dF1 (kg) | 11 | 236 | 460 | 685 | 910 |
| dF2 (kg) | 1789 | 1564 | 1340 | 1115 | 890 |
| dL car (mm) | 0.9 | 16.1 | 26.8 | 33.2 | 35.2 |

Case 3: the bottom pulley 14 is braked and the top pulley 12 is braked:

$$k_1 = k_{11} = \frac{A_1 E_1}{L_{11}}$$

$$k_2 = k_{21} = \frac{A_2 E_2}{L_{21}}$$

The data for Case 3 are in Table 4. We observe that if the pulleys 12, 14 of both the top end and the bottom end are kept in their position with a brake, the displacement of the car 10 of our example case is 17.6 mm, i.e. approx. one-quarter of the displacement of a corresponding conventional solution.

TABLE 4

| Pretensioning force → nominal load | 0.00 | 0.25 | 0.50 | 0.75 | 1.00 |
|---|---|---|---|---|---|
| k1 (N/m) | 259585 | 344695 | 512839 | 1001257 | 21026394 |
| k2 (N/m) | 20072195 | 955819 | 489566 | 329052 | 247805 |
| dF1 (kg) | 23 | 477 | 921 | 1355 | 1779 |
| dF2 (kg) | 1777 | 1323 | 879 | 445 | 21 |
| dL car (mm) | 0.9 | 13.6 | 17.6 | 13.3 | 0.8 |
| 75 kg → (mm) dL car | 1.5 | 1.4 | 1.1 | 0.6 | 0.0 |

Data for the non-pretensioned elevator are presented in Table 5. As we observe, elongation of the displacement ropes of a conventionally designed elevator being implemented with the same dimensioning would produce with the nominal load a displacement of 68.0 mm of the car.

TABLE 5

| Pretensioning force → nominal load | 0.00 | 0.25 | 0.50 | 0.75 | 1.00 |
|---|---|---|---|---|---|
| k1 (N/m) | 259585 | 344695 | 512839 | 1001257 | 21026394 |
| dL car (mm) | 68.0 | 51.2 | 34.4 | 17.6 | 0.8 |
| 75 kg → dL car (mm) | 2.8 | 2.1 | 1.4 | 0.7 | 0.0 |

Figure 2:
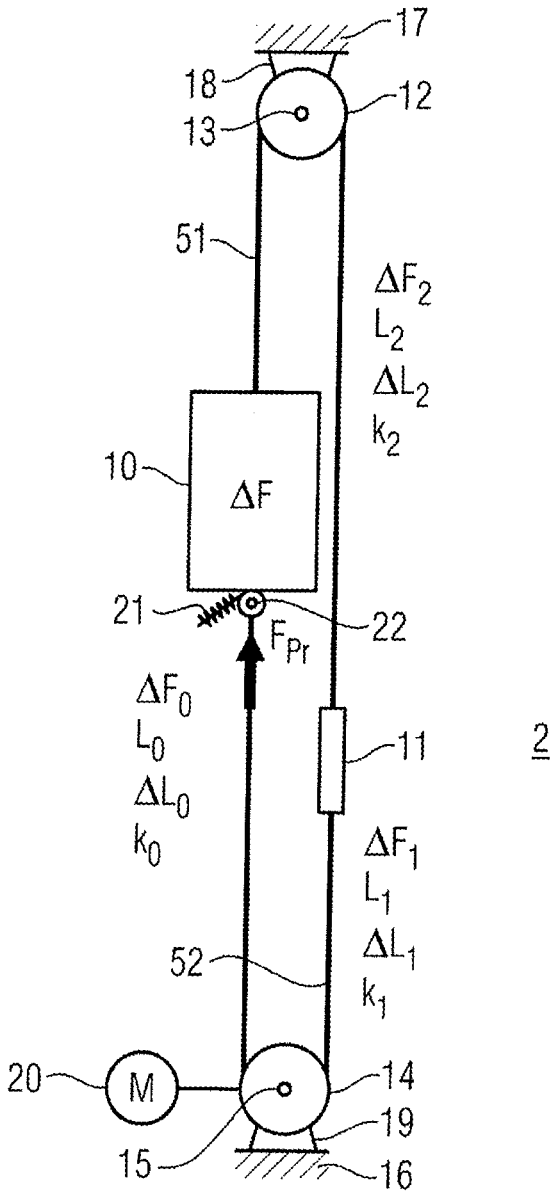
FIG. 2 illustrates a schematic view of an elevator corresponding to FIG. 1, in which is also marked to be visible a motor and tensioning means.

FIG. 2 presents an elevator of the type of FIG. 1, wherein also marked to be visible are a motor 20 and a tensioning unit, which comprises a spring 21 and a lock 22. The lock 22 is installed in connection with the car 10.

According to the markings presented in FIG. 2 we can write $$\Delta L_0=\Delta L_1+\Delta L_2 \tag{2.1}$$

and $$\Delta F=\Delta F_0+\Delta F_2 \tag{2.2}$$

For the spring constant $k_i$ the following still holds true:

$$k_i=\frac{A_iE_i}{L_i} \tag{2.3}$$

likewise for the forces $$\Delta F_1=\Delta F_2 \tag{2.4}$$

Also in the case of FIG. 2 we can write:

$$\Delta F_i=k_i\Delta L_i \tag{2.5}$$

and $$\Delta L_i=\frac{\Delta F_i}{k_i}. \tag{2.6}$$

By inserting and solving we obtain:

$$\frac{\Delta F_0}{k_0}=\frac{\Delta F_1}{k_1}+\frac{\Delta F_2}{k_2}=\Delta F_2\left(\frac{1}{k_1}+\frac{1}{k_2}\right) \tag{2.7}$$

$$\frac{\Delta F-\Delta F_2}{k_0}=\frac{\Delta F_2}{k_1}+\frac{\Delta F_2}{k_2} \tag{2.8}$$

and

-continued $$\Delta F_2=\frac{\Delta F}{\frac{1}{k_0}+\frac{1}{k_1}+\frac{1}{k_2}}. \tag{2.9}$$

When the pretensioning force of the roping is marked $F_{pr}$ we obtain:

When $F_{pr}>\Delta F_0$ in a situation in which the length of the roping is $L_{0,\ minimum}$, in a situation in which the change in force is estimated to be maximal, we obtain:

$$\Delta F_0=\frac{\Delta F\left(\frac{1}{k_1}+\frac{1}{k_2}\right)}{\frac{1}{k_0}+\frac{1}{k_1}+\frac{1}{k_2}} \tag{2.10}$$

from this it follows that $$\Delta L_{0,p}=\Delta F_2\left(\frac{1}{k_1}+\frac{1}{k_2}\right) \tag{2.11}$$

because the roping 51, 52 can be regarded as springs installed in parallel. When friction forces are ignored, $$\Delta F_1\approx\Delta F_2\approx\Delta F_3 \tag{2.12}$$

From which it follows that $$\Delta L_{0,s}=\Delta L_1+\Delta L_2=\Delta F\left(\frac{1}{k_1}+\frac{1}{k_2}\right), \tag{2.13}$$

in which case for the relative change in length we obtain $$\frac{\Delta L_{0,p}}{\Delta L_{0,s}}=\frac{1/k_0\Big/\left(\frac{1}{k_0}+\frac{1}{k_1}+\frac{1}{k_2}\right)}{\frac{1}{k_1}+\frac{1}{k_2}}$$

For example, in a case in which $$L_0=L_1, L_1=2L_0, A_0=A_1=0.5A_2 \text{ and } E_0=E_1=E_2$$

we obtain $$\frac{L_{0,p}}{L_{0,s}}=\frac{L_0/A_0\Big/\left(\frac{L_0}{A_0}+\frac{L_0}{A_0}+\frac{2L_0}{A_0}\right)}{\frac{L_0}{A_0}+\frac{2L_0}{2A_0}}=\frac{1/(1+1+1)}{1+1}=\frac{1}{6}.$$

If, correspondingly, there were not pretensioning in the fabricated elevator, the elasticity, or the relative change in length, would be much larger because the ropings 51, 52 would behave as springs installed in series and not as springs installed in parallel.

In an example embodiment, the elevator must not be regarded as being limited only to the claims below but instead should be understood to include all legal equivalents of said claims and combinations of the embodiments presented.

More particularly, instead of, or in addition to, the displacement ropes 51, 52 above, belts can be used. In the lattermost case, it is called displacement belting.

A person skilled in the art will also understand that use of the pretensioning of an elevator according to the invention for bracing the roping could also be expressed as a method wherein the roping is braced by the aid of pretensioning.

The invention claimed is:

1. An elevator, comprising:

an elevator car configured to transport a load;

a counterweight;

at least one roping or belting travelling over a top pulley assembly so as to connect the elevator car and the counterweight to each other via the top pulley assembly;

at least one roping or belting travelling over a bottom pulley assembly so as to connect the elevator car and the counterweight to each other via the bottom pulley assembly;

a tensioning device configured to pretension the at least one roping or belting travelling over the bottom pulley assembly to a force equal to or greater than a weight of a nominal load of the elevator car such that the at least one roping or belting is pretensioned prior to loading the elevator car; and at least one brake configured to increase a spring constant associated with at least one of the at least one roping or belting travelling over the top pulley assembly and the at least one roping or belting travelling over the bottom pulley assembly while loading the elevator car by preventing a rotation of the at least one of the top pulley assembly and the bottom pulley assembly while the tensioning device pretensions the at least one roping or belting travelling over the bottom pulley assembly.

2. The elevator according to claim 1, wherein the tensioning device includes a lock and a spring.

3. An improvement for reducing movement of the elevator car incident to elongation of the at least one roping or belting of the elevator during loading of the elevator car, wherein the elevator according to claim 1 is used so that the pretensioned at least one roping or belting traveling via the bottom pulley assembly and the at least one roping or belting traveling via the top pulley assembly interact with each other and provide a reduction of the movement of the elevator car during the loading of the elevator car incident to elasticities of the at least one roping or belting travelling via the top pulley assembly and the at least one roping or belting traveling via the bottom pulley assembly as compared to when the at least one roping or belting traveling via the bottom pulley assembly is not pretensioned.

4. The elevator according to claim 1, wherein, for different loads, the pretensioning of the at least one roping or belting traveling via the bottom pulley assembly is pretensioned to different forces based on the different loads.

5. The elevator according to claim 1, wherein the pretensioning of the at least one roping or belting is configured to act on a section of the at least one roping or belting between the elevator car and the bottom pulley assembly.

6. The elevator of claim 1, wherein the at least one brake comprises:

a top brake configured to prevent the rotation of the top pulley assembly while loading the elevator car; and a bottom brake configured to prevent the rotation of the bottom pulley assembly while loading the weight of the load into the elevator car.

7. The elevator of claim 1, wherein, while the tensioning device pretensions the at least one roping or belting travelling over the bottom pulley assembly, the at least one brake is configured to, increase a spring constant associated with the top pulley assembly while loading the elevator car, when the at least one brake prevents the rotation of the top pulley assembly, increase a spring constant associated with bottom top pulley assembly while loading the elevator car, when the at least one brake prevents the rotation of the bottom pulley assembly, and increase spring constants associated with the top pulley assembly and the bottom pulley assembly while loading the elevator car, when the at least one brake prevents the rotation of both the top pulley assembly and the bottom pulley assembly.

8. A method of pretensioning of at least one roping or belting traveling over a bottom pulley assembly, the method comprising:

moving reciprocally an elevator car and a counterweight;

connecting the elevator car and the counterweight to each other via a top pulley assembly;

connecting the elevator car and the counterweight to each other via the bottom pulley assembly;

pretensioning the at least one roping or belting travelling over the bottom pulley assembly using a tensioning device, such that the pretensioning pretensions to a force equal to or greater than a weight of a nominal load of the elevator car such that the at least one roping or belting is pretensioned prior to loading the elevator car; and increasing a spring constant associated with at least one of the at least one roping or belting travelling over the top pulley assembly and the at least one roping or belting travelling over the bottom pulley assembly while loading the elevator car by preventing a rotation, using at least one brake, of the at least one of the top pulley assembly and the bottom pulley assembly of the at least one roping or belting while the elevator car is loaded.

9. The method according to claim 8, wherein, the preventing the rotation is performed at least in part by a brake device.

10. The method according to claim 8, wherein, the preventing the rotation includes preventing a rotation of two or more pulleys of the top pulley assembly or the bottom pulley assembly at least in part by the at least one brake.

11. The method according to claim 10, wherein, the preventing the rotation includes preventing a rotation of at least one pulley of the top pulley assembly and a rotation of at least one pulley of the bottom pulley assembly.

12. A method of operating an elevator, the elevator including an elevator car connected to a counterweight via a top pulley assembly using a first rope, and a bottom pulley assembly using a second rope and a tensioning device, the method comprising:

pretentioning, using the tensioning device, the second rope, to a force equal to or greater than a nominal weight of the elevator car such that the second rope is pretensioned prior to loading the elevator car; and increasing a spring constant associated with at least one of the first rope and the second rope while loading the elevator car by preventing a rotation, using at least one brake, of at least one of the top pulley assembly and the bottom pulley assembly while the elevator car is loaded.

13. The method according to claim 12, wherein the increasing the spring constant includes preventing the rotation of both the top pulley assembly and the bottom pulley assembly while loading the elevator car.

* * * * *